US006385796B1

(12) United States Patent
Muir, Jr.

(10) Patent No.: US 6,385,796 B1
(45) Date of Patent: May 14, 2002

(54) SELF FLUSHING URINAL WITH INTEGRATED GAMING AND REWARD SYSTEM

(76) Inventor: David N. Muir, Jr., 5424 Tree Line Dr., Centreville, VA (US) 20120

( * ) Notice: Subject to any disclaimer, the term of this patent is extended or adjusted under 35 U.S.C. 154(b) by 0 days.

(21) Appl. No.: 09/850,157

(22) Filed: May 8, 2001

(51) Int. Cl.[7] ..... A47K 1/00; E03C 1/00
(52) U.S. Cl. ..... 4/661; 4/304; 4/305
(58) Field of Search ..... 4/661, 302, 304, 4/305, 902

(56) References Cited

U.S. PATENT DOCUMENTS 5,652,975 A * 8/1997 Hoskin ..... 4/483
5,748,096 A * 5/1998 Kaufer ..... 340/686.1
5,829,073 A * 11/1998 Lee ..... 4/242.1

FOREIGN PATENT DOCUMENTS

JP 6-117011 * 4/1994 ..... 3/305

* cited by examiner

*Primary Examiner*—Gregory L. Huson
*Assistant Examiner*—Tuan Nguyen

(57) ABSTRACT

This interactive urinal is for improving sales and provides revenue from the restroom, especially in an establishment that sells beverages. The urinal is coin vended to provide amusement and also to provide income from obligatory restroom requirements. The Urinator allows an owner to permit the dispensing of rewards to promote equipment or products for sale elsewhere. It is envisioned that the Urinator may provide tickets for free products upon the attainment of certain amounts of a customer urine output coordinated with appropriate accuracy. Coin operation and anti-cheating devices are disclosed.

16 Claims, 5 Drawing Sheets

SELF FLUSHING URINAL WITH INTEGRATED GAMING AND REWARD SYSTEM

BACKGROUND OF THE INVENTION

It is well known that men have a highly developed competitive nature. It is also well known that men will aim their urine stream at something, especially items that may be in a urinal, from the drain, to holes in the drain cover, to cigarette butts, etc.

SUMMARY OF THE INVENTION

The Urinator is a urinal that is equipped with a microprocessor, sound, light display, printing mechanism, a variety of sensors, timer, all battery powered which is intended to present a challenge for men using a urinal for their entertainment.

This Urinator is also designed to generate revenue for the owner of the establishment in a room which is normally a financial drain.

DESCRIPTION OF THE PREFERRED EMBODIMENTS

Figure 1:
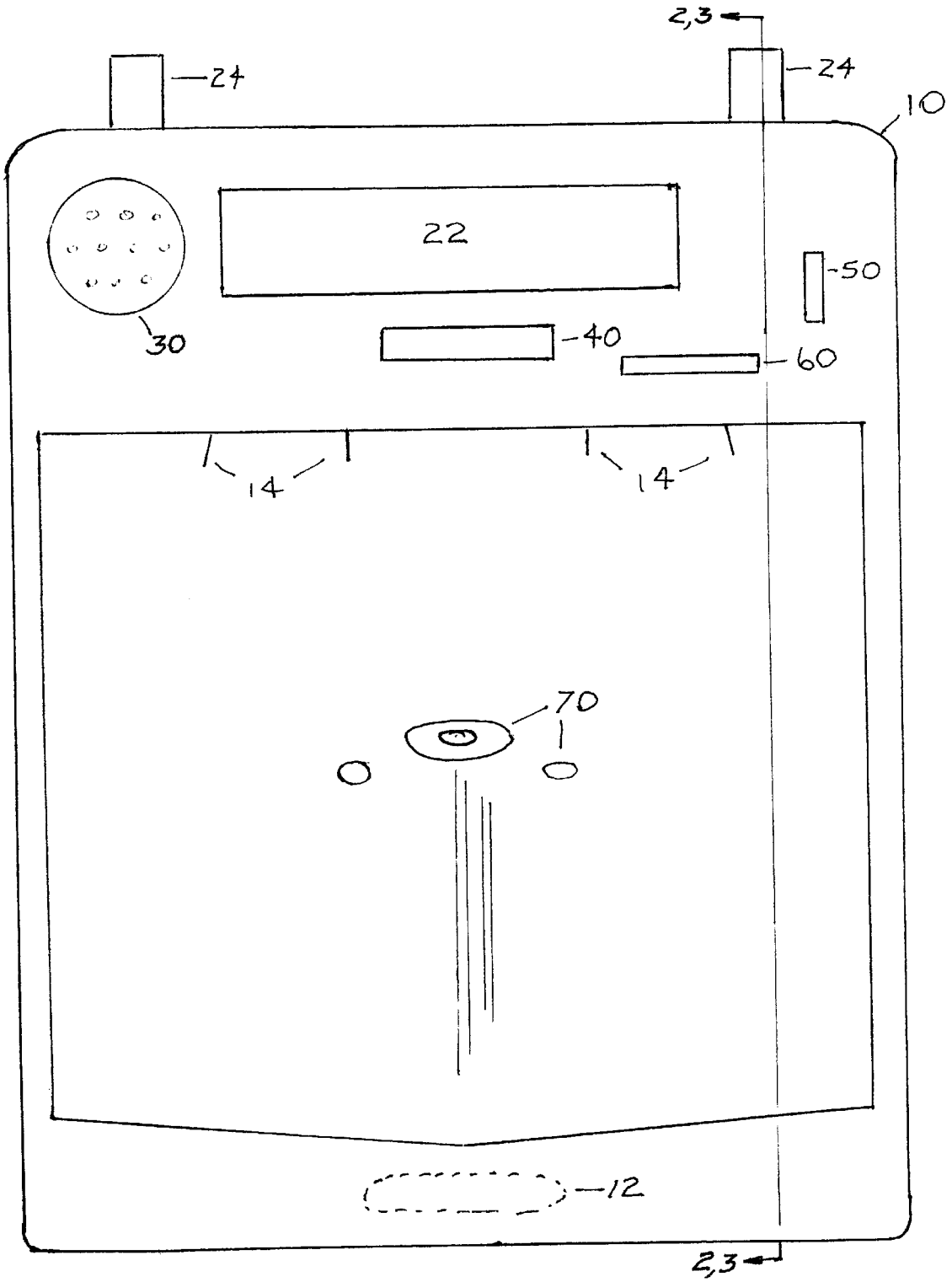
FIG. 1 is a front view of the invention.

FIG. 1 shows urinal 10 with readout and advertising on LCD display 22. Lights 24 may be used either before or during or after use of the urinal to attract attention and possible users. Speaker 30 is used to also attract attention and especially for announcing failure or success of a user. Infrared sensor 40 is provided to establish when a user is present and to provide for automatic flushing. Reward Slot 60 will output a reward token for success. This device is provided with vending slot 50 so that users can initiate the systems. As all urinals must, it is provided with a drain 12 and flushes 14 but also targets 70 that a user may aim at after the system is started.

Figure 2:
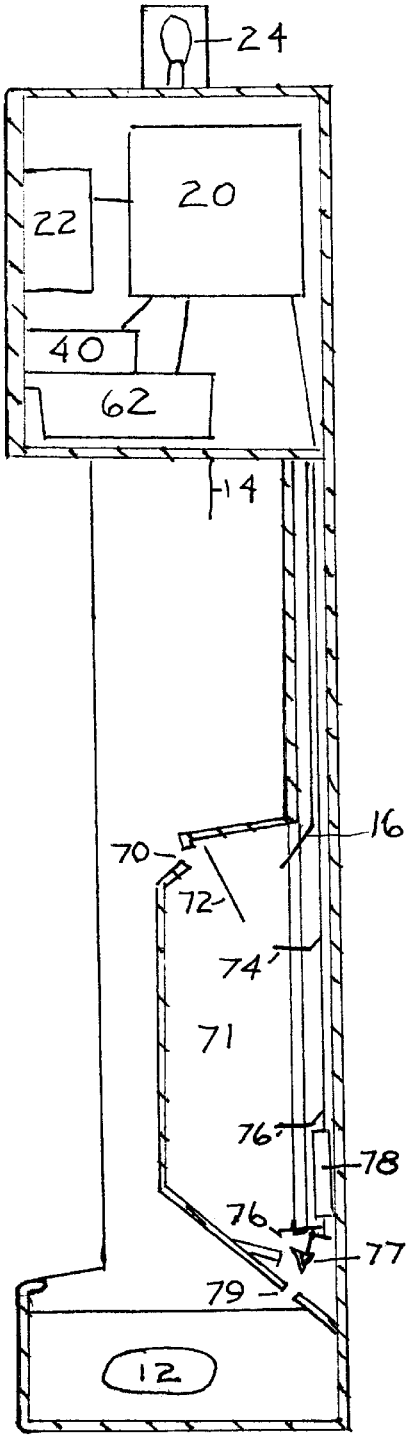
FIG. 2 is a sectional view of the invention taken along line 2—2 of FIG. 1.

As seen in FIG. 2, the urinal has a microprocessor 20 which is the logic brain of the system. This microprocessor is powered from battery 28, see FIG. 5. The microprocessor 20 is wired to all elements before mentioned and to urine level sensors 74, 76 which may be electrodes that directly contact the internal void 71. Pressure plate 72 is connected to the microprocessor 20 to initiate the timing of the system and for other outputs such as goading sound clips which are stored in the microprocessor 20 and output through speaker 30 with appropriate visual display on LCD 22. The void 71 is flushed through flush port 16 and drained through drain 79 to urinal drain 12, the channel from drain 79 to drain 12 may be internal, not shown. This drain 79 is closed upon initiation by plug 77 which is normally open until shut by solenoid 78, which is also controlled by microprocessor 20.

The sensor 40, which may be any standard infra-red sensor, is connected to the microprocessor 20 and is used to inform the microprocessor of a user's presence. This is also used to inform the microprocessor of a user moving away from the urinal to terminate the system actions and initiate a flush. This is intended to reduce cheating by having several users lining up to generate the volume for success. The reward slot 60 is to enable a user to obtain a physical reward for later redemption. The reward may be a preprinted ticket or may be provided by a printer that may generate any reward the owner may wish to provide.

Though the Urinator is everything that a urinal must be, it is to be understood that the body may be made of other materials than porcelain. The Urinator body may be made of any type of plastic, such as PVC, polyurethane, polyethelene, etc., or even ceramics or metals.

Figure 3:
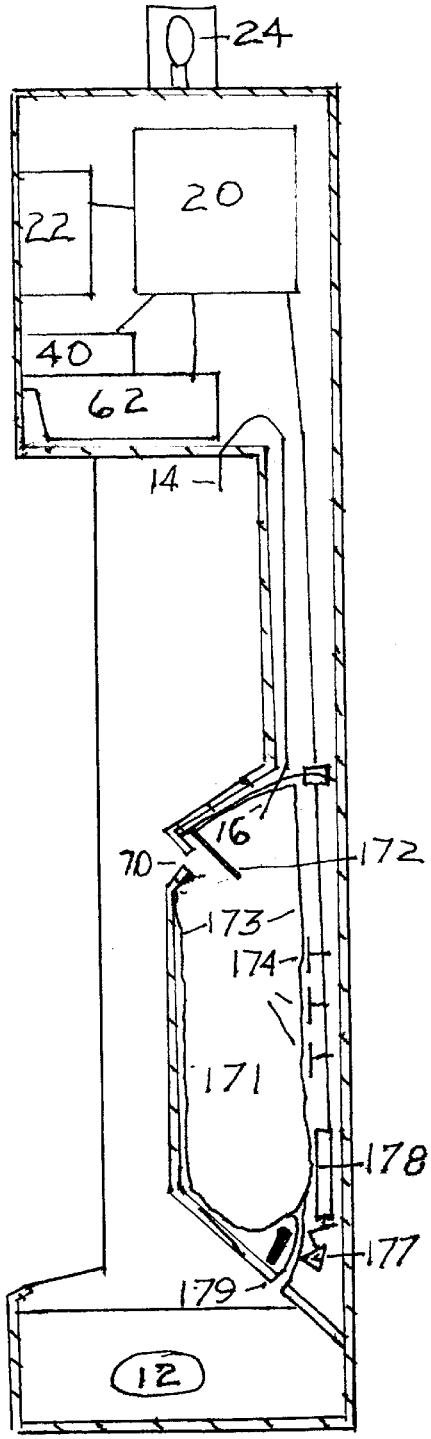
FIG. 3 is a sectional view of the invention taken along line 2—2 of FIG. 1 but providing an alternative measurement system.
Figure 4:
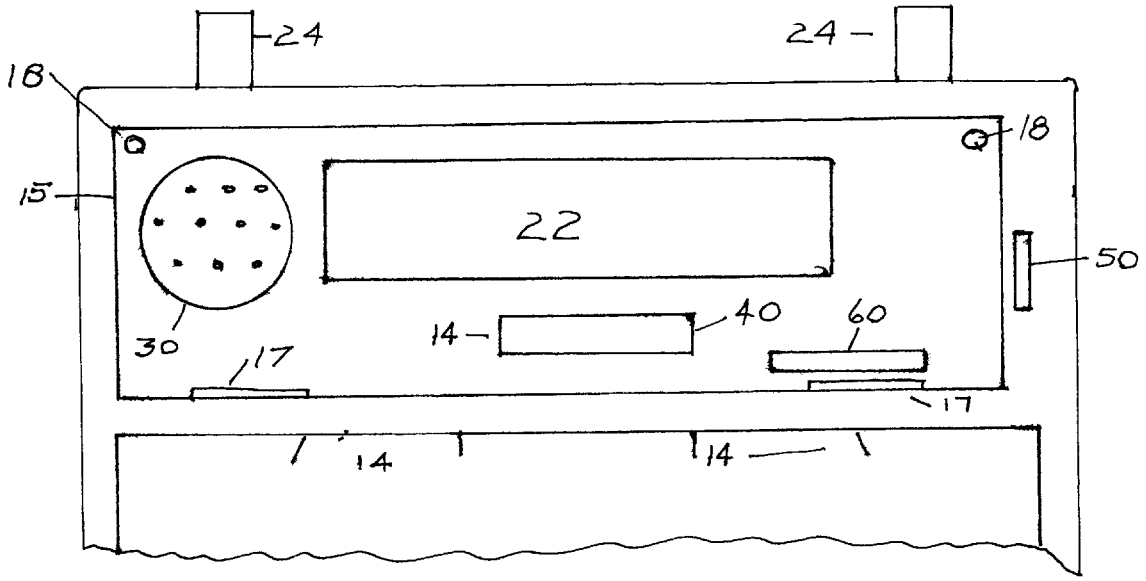
FIG. 4 is a partial front view of an alternative top portion of the invention with access door.

As seen in FIG. 3, the lights, LCD, sensor, speaker and reward slot are connected to the microprocessor 20. The differences between this and FIG. 2 are better understood as disclosed below in the discussion of FIG. 6.

Figure 5:
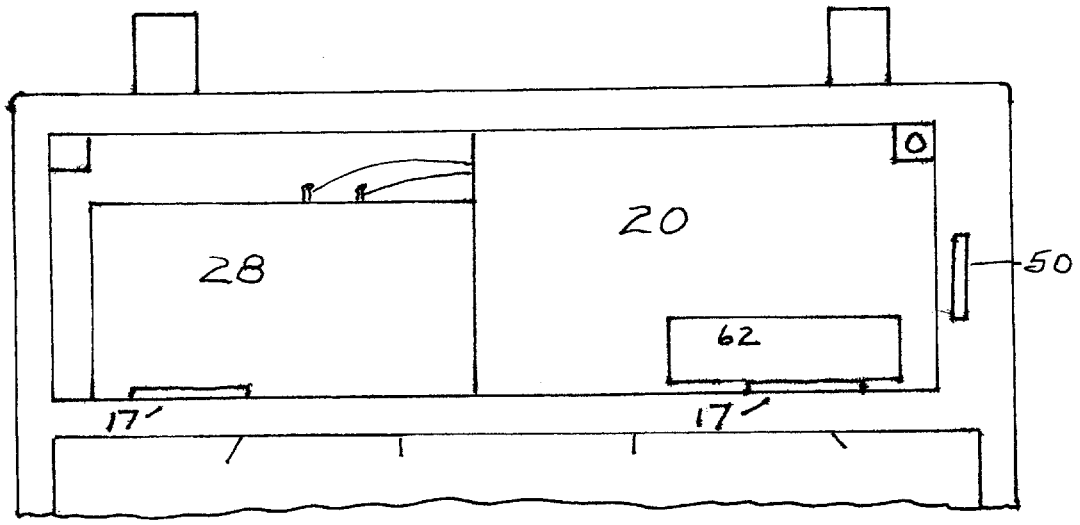
FIG. 5 is a partial front view of the invention of FIG. 4 with the access door open.

As another option, the front of the Urinator has a drop down panel 15 that mounts the LCD display 22, the speaker 30, the sensor 40, the reward slot 60. It is hinged at hinges 17 and is fastened by quick disconnect fasteners 18, which should be locked against tampering. As seen in FIG. 5, the microprocessor 20, battery 28 and reward token dispenser 62 are accessed through panel 15. Vending mechanism 50 is equipped to handle bills or coins and is accessed by a user through vending mechanism 50 but is serviced by the owner through panel 15 or a side panel, not shown, as is standard in the industry.

Figure 6:
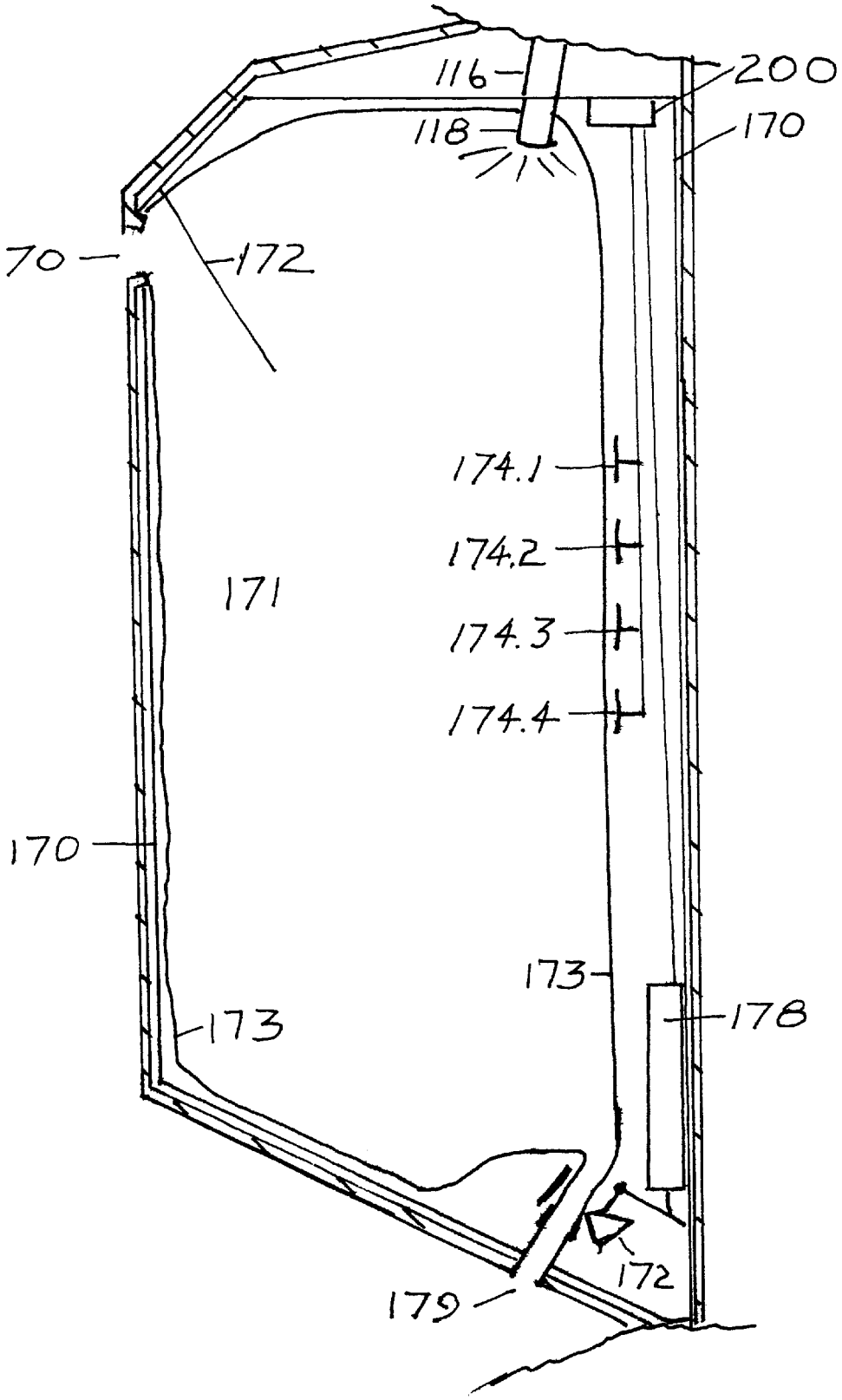
FIG. 6 is a sectional view of the quick replacement bladder assembly.

FIG. 6 shows an alternative concept for the void and target. Target 70 now feeds to pressure plate 172 which deflects to void 171 which is surrounded by flexible bladder 173. The bladder 173 is normally open to drain through drain 179 . Upon activation, microprocessor 20 activates solenoid 178 to pinch off the drain with clamp 177. Sensors 174 (174.1–174.4) measure pressure provided at that location from liquid in the bladder. The sensors may also measure temperature to reduce cheating. Any of many different types of pressure and temperature sensors may be used and not obviate the inventiveness of the Urinator. Flush water is provided by port 116 however it is recommended that the flush water be sprayed through nozzle 118 to clear the inside surface of the bladder. The bladder 173, pressure plate 172, sensors 174, solenoid 178, clamp 177, drain 179, nozzle 118 are contained in package 170 for ease of maintenance and sanitation. Package 170 is provided with an electrical connection 200 so that all electrical devices mentioned may be linked to the microprocessor 20 easily.

Figure 7:
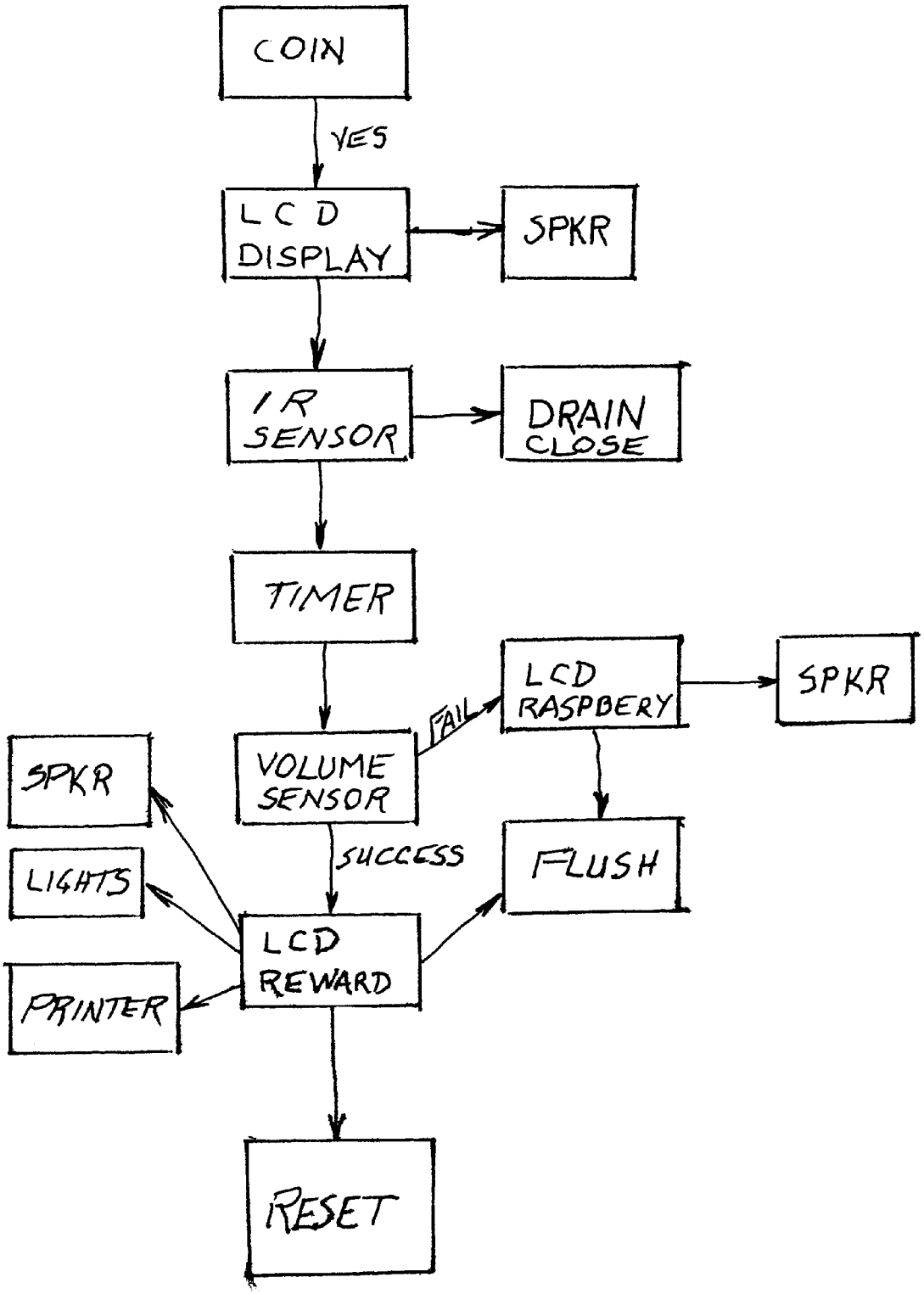
FIG. 7 is an example of a logic chart.

The use of the device is best shown by FIG. 7 where the user initiates microprocessor 20 which starts the LCD display. The Speaker 30 starts the chosen sound clips and the sensor 40 confirms the presence of a user, whereupon the drain is closed by the solenoid 78,178. A timer is activated in the microprocessor and the level sensors are initiated. Upon the termination of a set period of time or the movement away of the user the microprocessor determines whether the user failed or succeeded. Upon failure the LCD and the speaker output a chosen response and the unit flushes and resets. Upon success, the LCD, speaker, lights and reward slot are activated with a chosen reward sequence, the unit flushes and resets.

What is claimed is:

1. An interactive urinal comprising;

a urinal with a water supply and a drain for flushing human waste, at least one target means, a power supply connected to a microprocessor, the microprocessor connected to and controlling a visual display means, a sensor means, a sounding means, a vending means and a reward means, wherein when the interactive urinal is approached by a human user and the vending means is activated, the microprocessor closes a normally open drain and a urine volume sensor means is activated to determine whether the human user has achieved a desired target volume, and if the desired target volume is reached, the visual display means is activated, the sounding means is activated in a rewarding mode and the reward means is activated to produce a tangible reward for the human user.

2. An interactive urinal as set forth in claim 1;

wherein the visual display means is controlled by the microprocessor to display enticing messages and advertisements and wherein the visual display means comprises an LCD.

3. An interactive urinal as set forth in claim 2;

wherein the visual display means includes a light system.

4. An interactive urinal as set forth in claim 1;

wherein the sensor means comprises a mechanism to detect a human user to determine when a user is present and when the human user moves away.

5. An interactive urinal as set forth in claim 1;

wherein the urine volume sensor means comprises a mechanism to determine the amount of fluid impacting said target means.

6. An interactive urinal as set forth in claim 1;

wherein the sounding means includes a sound transducer that is fed data from the microprocessor to attract a human user, entertain a human user and indicate an achieved level of success.

7. An interactive urinal as set forth in claim 1;

wherein the reward means outputs preprinted tickets.

8. An interactive urinal as set forth in claim 1;

wherein the reward means is a printing mechanism that outputs a printed voucher as established by the urinal owner.

9. An interactive urinal as set forth in claim 1;

wherein the microprocessor is programmed to flush the urinal and reset the target means.

10. An interactive urinal as set forth in claim 1;

wherein the target means further comprises a void with a normally open valve and a mechanism to close the valve and allow the void to fill upon activation.

11. An interactive urinal as set forth in claim 10;

wherein the target means is encompassed in a replacable package including a flexible bladder with at least one pressure sensitive sensor to establish the desired target volume, said at least one pressure sensor being connected to the microprocessor.

12. An interactive urinal as set forth in claim 1;

wherein the microprocessor is provided with a timing circuit that provides a set time period to achieve the desired target volume whereupon the end of the set time period the urinal is set to flush and the visual and audible displays are activated by the microprocessor.

13. An interactive urinal as set forth in claim 1;

wherein the target means has a pressure plate that deflects a urine stream into a void and includes a plurality of targets and pressure plates of different difficulties.

14. An interactive urinal as set forth in claim 1;

wherein the target means is provided with a pressure plate sensor which is connected to the microprocessor, the microprocessor programmed to output a variety of different sound data to the sounding means.

15. An interactive urinal as set forth in claims 1;

wherein the urinal is constructed of one of porcelain, metal, fiberglass and plastic.

16. A method of using the urinal as set forth in claim 1 by;

placing the urinal in a public restroom, providing water supply and power to said urinal, allowing a user to insert a fee, providing sound and visual inducements, measuring the amount of urine that said urinal receives from a human user, and providing a reward for the desired target volume.

* * * * *